United States Patent [19]

Barneveld et al.

[11] 3,992,207

[45] Nov. 16, 1976

[54] METHOD OF MANUFACTURING A CATHODE-RAY TUBE FOR THE DISPLAY OF COLORED IMAGES

[75] Inventors: Dirk Barneveld; Gerardus Antonius Wilhelmus Vermeulen, both of Eindhoven, Netherlands

[73] Assignee: U.S. Philips Corporation, New York, N.Y.

[22] Filed: Feb. 26, 1975

[21] Appl. No.: 552,979

[30] Foreign Application Priority Data

Mar. 11, 1974 Netherlands ..... 7403205

[52] U.S. Cl. ..... 96/36.1; 427/68

[51] Int. Cl.[2] ..... G03C 5/00

[58] Field of Search ..... 96/36.1; 354/1; 427/68

[56] References Cited

UNITED STATES PATENTS

| | | | |
|---|---|---|---|
| 2,840,470 | 6/1958 | Levine | 96/36.1 |
| 3,558,310 | 1/1971 | Mayaud | 96/36.1 |
| 3,585,034 | 6/1971 | Levinos | 96/36.1 |
| 3,614,504 | 10/1971 | Kaplan | 96/36.1 |
| 3,623,867 | 11/1971 | Saulnier | 96/36.1 |
| 3,661,580 | 5/1972 | Mayaud | 96/36.1 |
| 3,712,815 | 1/1973 | Rohrer et al. | 96/36.1 |
| 3,837,885 | 9/1974 | Angelucci | 96/36.1 |
| 3,881,928 | 5/1975 | Gravestein et al. | 96/36.1 |
| 3,915,707 | 10/1975 | Gesswein et al. | 96/36.1 |

*Primary Examiner*—Edward C. Kimlin

*Attorney, Agent, or Firm*—Frank R. Trifari; George B. Berka

[57] ABSTRACT

Method of manufacturing a display screen for a shadow mask tube by projecting a negative image of the shadow mask on support provided with a first photosensitive layer, removing the unexposed regions by means of a solvent, depositing a second photosensitive layer containing a luminescent material of one color dissolved in a solution which becomes insoluble by exposure but is not attacked by an etchant which affects the first layer, exposing the second layer, and removing the exposed regions of the first layer together with superposed portions of the second layer, by the etchant.

4 Claims, 2 Drawing Figures

METHOD OF MANUFACTURING A CATHODE-RAY TUBE FOR THE DISPLAY OF COLORED IMAGES

Figure 1:
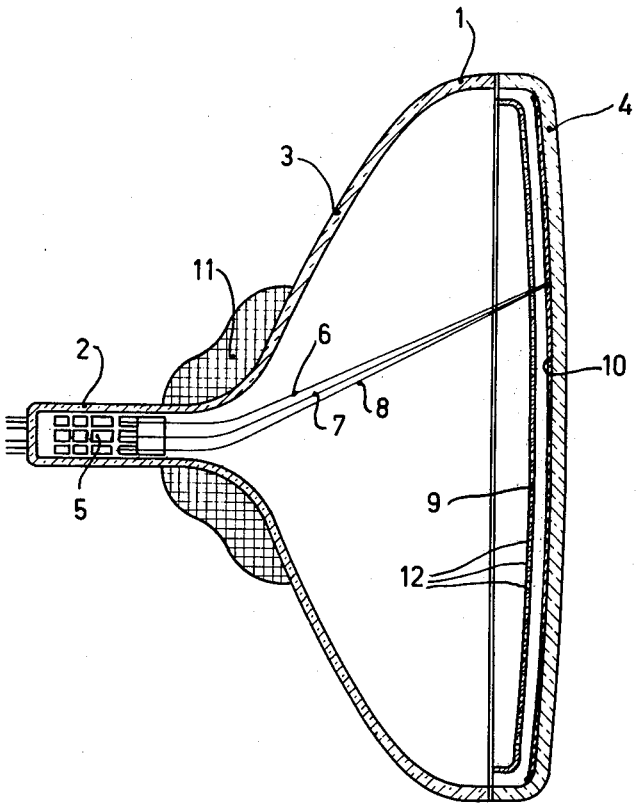

The invention relates to a method of manufacturing a cathode-ray tube for displaying coloured images which is provided with: a display screen comprising a large number of areas which luminesce in three different colours, means for generating three electron beams, and a colour selection electrode having a large number of apertures, the said electron beams each being associated by means of the colour selection electrode with luminescent areas of one colour, which luminescent areas are smaller or narrower than the corresponding apertures in the colour selection electrode. The invention also relates to a cathode-ray tube manufactured by the said method.

A cathode-ray tube for displaying coloured images in which the luminescent areas are smaller or narrower than the corresponding apertures in the colour selection electrode is described in U.S. Pat. No. 3,146,368. Such a tube, which has what is generally referred to as negative landing tolerance for the electron beams on the luminescent areas, has the advantage that less ambient light is reflected by the display screen than in tubes which have positive tolerance and in which the electron spots are smaller or narrower than the luminescent areas. As a result, the image displayed has very good contrast.

In the method of exposure used for manufacturing display screens for negative-tolerance tubes it proves very difficult in practice to obtain an image of reduced size of the apertures in the colour selection electrode. A method of avoiding this difficulty comprises exposure by means of a colour selection electrode the apertures in which are temporarily reduced in size or exposure by means of a colour selection electrode formed with small apertures which subsequently are enlarged. Such a process obviously means an enormous complication for industrial mass production and preferably is to be avoided.

French Pat. No. 2,095,968 (PHN 4900) describes what is referred to as a direct exposure method for obtaining a reduced-sized image of apertures in the shadow mask. This method uses a source of light having a light distribution such that behind each aperture in the colour selection electrode a light spot is produced which is surrounded by a penumbra. By careful development of the exposed layer this penumbra may be used to obtain an image of reduced size. However, this method has the disadvantage of requiring very careful development and moreover the size of the image is not highly reduced.

U.S. Pat. No. 3,152,900 and German patent application No. 2,248,878 laid open to public inspection describe a method of exposure in which a negative image of reduced size is obtained, that is to say, each aperture in the colour selection electrode is imaged as a shadow reginn of reduced size or width on the photosensitive layer. An advantage of such a method is that the area which is insufficiently exposed to become hardened is reduced in size or width in proportion as exposure time increases, so that substantially any desired reduction is obtainable. This is an important difference from the method described in the aforementioned French patent specification No. 2,095,968 in which the size of the reduced image increases with increase of exposure time and which consequently does not permit of obtaining any desired degree of reduction. However, the provision of luminescent material which is contained in the photosensitive layer to be exposed by the method described in the aforementioned U.S. Pat. No. 3,152,900 and the abovementioned German patent application 2,248,878 requires the use of a photosensitive layer which in the unexposed state is insoluble and becomes soluble by exposure to light. Such photosensitive layers require long exposure times and preferably are not used. To avoid this disadvantage, according to the German patent application No. 2,248,878 the method is used for providing light-absorbing material between the luminescent areas to be subsequently provided, so that reverse development as described in U.S. Pat. No. 3,558,310 is required here also. However, such a method cannot simply be used for luminescent material, because it would result in insufficient adherecne of the grains of luminescent material.

It is an object of the present invention to provide a method in which, after development, luminescent material is provided at non-exposed areas of a photosensitive layer which becomes insoluble by exposure to light. The luminescent areas obtained according to this method are smaller or narrower than the apertures in the colour selection electrode and may, for example, have the shape of narrow substantially parallel strips.

For this purpose a method according to the invention comprising the following steps:

a. providing on a support for the display screen a first layer which when exposed to actinic radiation becomes insoluble in a solvent but can be removed by an etchant,
b. exposing the said first layer to actinic radiation with the exception of the areas which are assigned to the luminescent areas of a first colour,
c. developing the said first layer by dissolving and removing the unexposed areas by means of the said solvent,
d. providing on the said support a second layer which contains luminescent material of the said first colour and becomes insoluble by exposure to actinic radiation but is not attacked by the said etchant,
e. exposing the entire second layer to actinic radiation,
f. removing the exposed areas of the said first layer together with the portions of the second layer situated on these exposed areas by treating both layers with the said etchant,
g. repeating the steps (a) to (f) for the luminescent areas of a second colour,
h. repeating the steps (a) to (f) for the luminescent areas of a third colour.

The exposure to actinic radiation mentioned in step (e) preferably is performed through the said support for the display screen, resulting in very good adherence of those portions of the said second layer which are in direct contact with the said support.

The said first and second layers preferably both contain polyvinyl alcohol as the substance to be made insoluble by exposure to light, the first layer being sensitized with ammonium dichromate and the second layer being sensitized with a tetradiazonium compound or a polydiazonium compound.

A suitable polydiazonium compound is, for example, the condensation product of paraphenyl aminobenzene diazonium nitrate and paraformaldehyde.

It should be mentioned that removing a hardened polyvinyl alcohol layer sensitized with ammonium dichromate by means of an etchant, such as hydrogen-peroxide, is described in U.S. Pat. No. 3,558,310. However, in the present invention, inter alia the insight is utilized that the decomposition reaction due to such etchants is catalysed by ammonium-dichromate but not by polydiazonium compounds.

Figure 2:
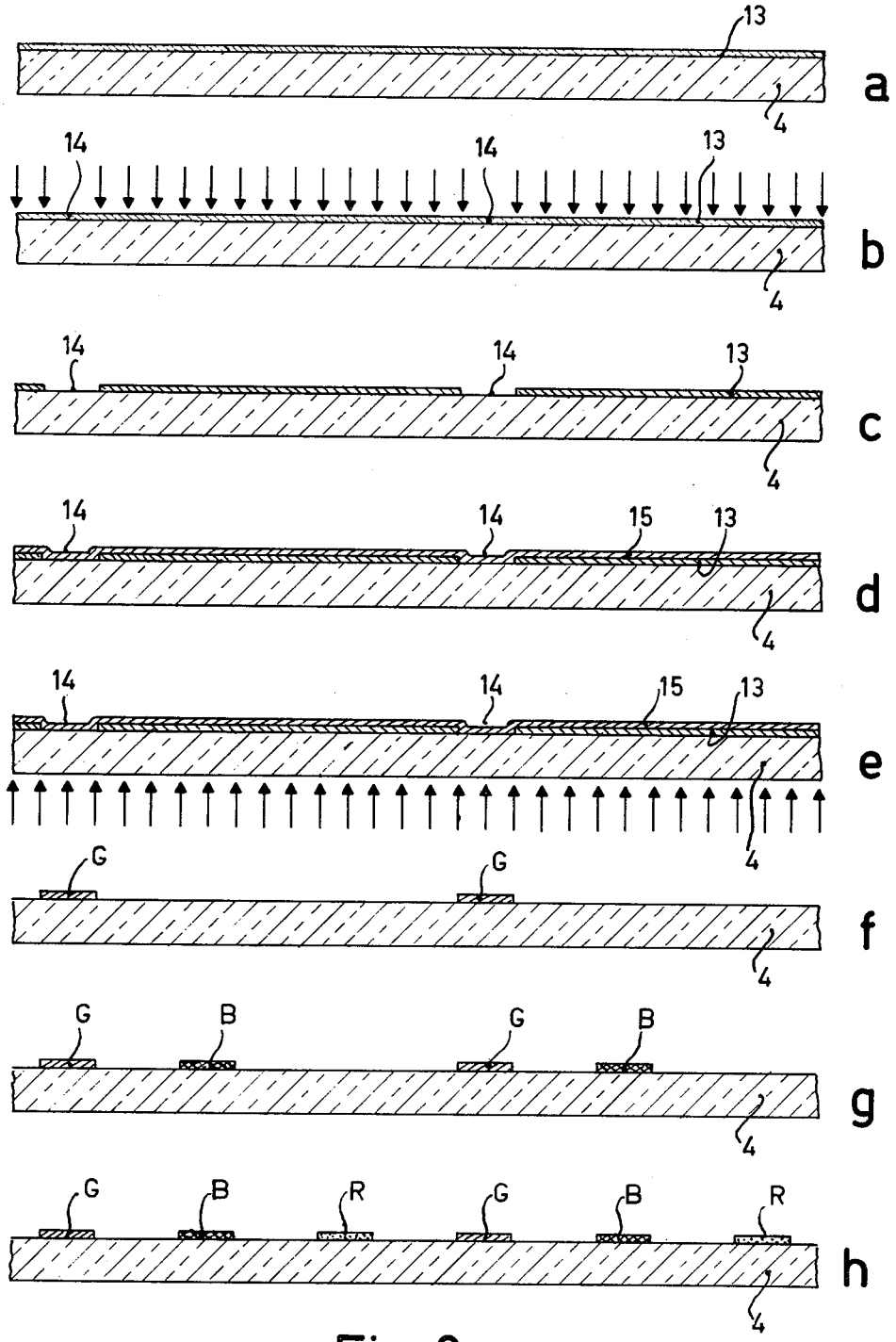

An embodiment of the invention will now be described, by way of example, with reference to the accompanying diagrammatic drawings, in which FIG. 1 is a sectional view of a cathode-ray tube for displaying coloured images according to the invention, and FIG. 2 shows sectional views of the display screen of this tube in various stages of the manufacturing process.

The tube shown in FIG. 1 contains, in a glass envelope which comprises a neck portion 2, a funnel portion 3 and a face plate 4, means 5 for producing three electron beams 6, 7 and 8, a colour selection electrode (shadow mask) 9 and a display screen 10. The tube further has a set of deflection coils 11 by which the electron beams are deflected so as to scan the display screen 10. The electron beams 6, 7 and 8 are produced with their axes in one plane which is the plane of the drawing in FIG. 1. The shadow mask 9 is formed with a large number of rectangular apertures 12 which are arranged in substantially parallel rows extending at right angles to the plane of the drawing. The axes of the electron beams 6, 7 and 8 intersect in a point situated substantially on the display screen 10. The display screen 10 comprises a large number of substantially parallel phosphor & strips which luminesce in red, green and blue and the direction of length of which is at right angles to the plane of the drawing. The position of the shadow mask 9 relative to the display screen 10 is such that the electron beam 7 impinges on green luminescing phosphor strips only and the beams 6 and 8 impinge on red and blue luminescing phosphor strips respectively only.

The display screen 10 is manufactured by means of a photochemical method according to the invention which will be explained more fully with reference to FIG. 2.

FIG. 2 shows part of the display screen 10 on the face plate 4 in various stages (a) to (h) of the manufacturing process. Manufacture starts from a thoroughly cleaned face plate 4 which is provided with a photosensitive layer 13, as is shown in FIG. 2*a*. The layer 13 is obtained by drying a layer which consists of an aqueous solution containing 4.5 per cent by weight of polyvinyl alcohol (for example the polyvinyl alcohol which is marketed by the Japanese firm Denki under the trade mark Denka Poval B24) and 0.15 per cent by weight of ammonium dichromate. Such a layer is sensitive to actinic radiation, which in this case means that it is soluble in water and by exposure to ultraviolet radiation becomes insoluble in water.

The photosensitive layer 13 then is exposed, as is indicated in FIG. 2*b* by arrows, for 1.5 minutes to ultraviolet radiation with the exception of areas 14 at which subsequently the green luminescing phosphor strips will be disposed. As a result the layer 13 becomes insoluble in water except at the areas 14 in which solubility is retained. Exposure is effected through the apertures 12 in the shadow mask 9 by the method described in the abovementioned German patent application No. 2,348,878, however, with slightly displaced sources of light so that the shadow regions do not fall between the subsequently provided phosphor areas of two colours but coincide with the subsequently provided phosphor areas of one colour.

The layer 13 then is developed by rinsing with water at a temperature of about 30° C so that in the areas 14 the layer 13 is removed from the face plate 4, as is shown in FIG. 2*c*.

As FIG. 2*d* shows, the layer 13 and the areas 14 then are covered by a layer 15 which contains a green-luminescing phosphor. The layer 15 is sensitive to actinic radiation, which again means that it is soluble in water and by exposure to ultraviolet radiation becomes insoluble in water. The layer 15 is obtained by drying a layer which comprises an aqueous solution containing 3 per cent by weight of polyvinyl alcohol (for example the polyvinyl alcohol marketed by the Japanese firm Denki under the trace mark Denak Poval B24), 0.5 per cent by weight of a polydiazonium compound which is the condensation product of paraphenyl amino-benzene diazonium nitride and paraformaldehyde, and 25 per cent by weight of a green-luminescing phosphor, namely copper-activated zinc cadmium sulphide. Other polydiazonium compounds which are suitable as sensitizers for use in a method according to the invention are the condensation products with paraformaldehyde of paraphenyl aminobenzene diazonium tetrachlorozincate, 4-paratoluylthio-2-6-diethoxybenzenediazonium tetrachlorozincate and paravinyl aminobenzene diazosulphonic-acid sodium.

As is indicated by arrows in FIG. 2*e*, the entire layer 15 then is exposed to ultraviolet radiation having a wavelength of about 365 nm for 1.0 minute. Because this exposure need not take place through the shadow mask, it preferably is effected through the glass of the face plate 4 in order to obtain good adherence of the layer 15 to the glass of the face plate 4 at the areas 14. Obviously fair results will also be attained by exposure from the other side.

The layers 14 and 15 then are treated with an etchant, for example an aqueous solution containing 4 per cent by weight of hydrogen peroxide. The decomposition reaction of such an etchant and polyvinyl alcohol is catalyzed by the sensitizer contained in the layer 13, i.e. ammonium dichromate, but is not catalyzed by the sensitizer contained in the layer 15, i.e. a polydiazonium compound. As a result, the layer 13 swells and softens and subsequently can be removed with water, whilst the layer 15 remains unaffected. As FIG. 2*f* shows, after rinsing with water the layer 13 has been removed together with those areas of the layer 15 which were disposed on the layer 13, so that only phosphor strips G remain at the areas 14.

The method described with reference to FIGS. 2*a* to 2*f* than is repeated, with the difference that the layer 15 now contains a blue-luminescent phosphor, such as silver-activated zinc sulphide. Thus phosphor strips B are provided, as is shown in FIG. 2*g*.

Subsequently the method as described with reference to FIGS. 2*a* to 2*f* is repeated another time using a red-luminescing phosphor, such as europium-activated yttrium oxysulphide. Thus phosphor strips R are provided, as is shown in FIG. 2*h*.

The display screen provided with green, blue and red phosphor strips as shown in FIG. 2*h* than is finished, for example by subjecting it to a heat treatment at a temperature of 450° C for 1 hour. As a result the residues of the polyvinyl alcohol, the polydiazonium compound and the other organic materials decompose and are removed by vaporisation. This socalled baking is preceded by aluminishing and, if desired, by the provision of light-absorbing material between the phosphor strips. According to the latest theory the said light-absorbing material may be omitted, as is stated in Netherlands patent application No. 7,310,371 (PHN 7026) not yet laid upon to public inspection, whilst aluminisation of the areas between the phoshor strips may be dispensed with, as is stated in Netherlands patent application No. 7,310,738 (PHN 7037) not yet laid open to public inspection.

What is claimed:

1. Method of manufacturing a color cathode ray tube including a display screen comprising a large number of areas which luminesce in three different colors, means for producing three electron beams, and a color selection electrode which is formed with a large number of apertures, the said electron beams each being associated by means of the color selection electrode with luminescent areas of one color, said luminescent areas being smaller than the corresponding apertures in the color selection electrode, comprising the steps of:

a. providing on a support for the display screen a first layer of an aqueous solution of polyvinyl alcohol which is sensitized with amonium dichromate which when exposed to actinic radiation becomes insoluble in a solvent but can be removed by an etchant, b. exposing the said first layer to actinic radiation with the exception of the areas which are assigned to the luminescent areas of a first color, c. developing the said first layer by dissolving and removing the unexposed areas by mans of the said solvent, d. providing on the said support a second layer which contains luminescent material of the said first color dissolved in an aqueous solution of polyvinyl alcohol sensitized with a tetrazonium compound or a polydiazonium compound and becomes insoluble by exposure to actinic radiation but is not attacked by the said etchant.

e. exposing the entire second layer to actinic radiation, f. removing the exposed areas of the said first layer together with the portions of the second layer disposed on these exposed areas by treating both layers with the said etchant, g. repeating the steps a) to f) for the luminescent areas of a second color, and h. repeating the steps a) to f) for the luminescent areas of a third color.

2. Method as claimed in claim 1, wherein the exposure to actinic radiation mentioned in step (e) is effected through the said support for the display screen.

3. Method as claimed in claim 1 wherein the said polydiazonium compound is the condensation product of paraphenyl aminobenzene diazonium nitrate and paraformaldehyde.

4. Method as claimed in claim 1, wherein said solvent is water and said etchant includes hydrogenperoxide.

* * * * *